US006142471A

United States Patent [19]

Goldman

[11] Patent Number: 6,142,471

[45] Date of Patent: Nov. 7, 2000

[54] LOGICAL TOY

[76] Inventor: Igor Goldman, 19700 Greeenolde, Montgomery, Md. 20879

[21] Appl. No.: 09/262,638

[22] Filed: Mar. 4, 1999

[51] Int. Cl.[7] ..... A63F 9/08

[52] U.S. Cl. ..... 273/153 S

[58] Field of Search ..... 273/153 R, 153 S, 273/155

[56] References Cited

U.S. PATENT DOCUMENTS

| | | | |
|---|---|---|---|
| D. 281,339 | 11/1985 | Hinnen . | |
| 4,410,179 | 10/1983 | Rubik . | |
| 4,557,484 | 12/1985 | Sherman . | |
| 4,708,345 | 11/1987 | Ayers . | |
| 4,881,738 | 11/1989 | Ayers . | |
| 5,172,912 | 12/1992 | Lammertink | 273/153 S |
| 5,370,394 | 11/1994 | Huncaga . | |
| 5,628,512 | 5/1997 | Chan . | |

FOREIGN PATENT DOCUMENTS

| | | | |
|---|---|---|---|
| 1806810 | of 1993 | Russian Federation . | |
| 1319886 | of 1987 | U.S.S.R. . | |
| 1382483 | of 1988 | U.S.S.R. . | |
| 1452533 | of 1989 | U.S.S.R. . | |
| 1715378 | 2/1992 | U.S.S.R. | 273/153 S |
| 1719000 | 3/1992 | U.S.S.R. | 273/153 S |

*Primary Examiner*—Raleigh W. Chiu
*Attorney, Agent, or Firm*—I. Zborovsky

[57] ABSTRACT

A logical toy has two coaxial, spring-biased parallel plates formed as disks which are concentrically turnable about a common axis and are provided with arcs, a plurality of toy logical elements surrounded by the arcs and turnable inside the arcs, the toy logical elements being formed as parts of a cylinder, one of the plates having an inner surface provided with a ring-shaped passage with depressions for fixing of a mutual turning of the plates, the other of the plates having an inner surface provided with ring-shaped projection corresponding to a diameter of the ring-shaped passage and having spherical projections, the ring-shaped projections having a height which is greater than a height of spherical projections, the ring-shaped passage with the depressions and the ring-shaped projection with the spherical projections being located concentrically to the axis of turning of the plates at the minimal distance from the axis, the arcs and the inner surfaces of the plates having a common sides provided with radii, the inner surfaces of the arcs having fixators of position of the toy logical elements which are formed as transverse slots, the plates being provided with setting openings, a movable and immovable attachments pressed-in the setting openings, massaging attachments and further attachments pressed in an outer surface of the plates.

20 Claims, 17 Drawing Sheets

LOGICAL TOY

BACKGROUND OF THE INVENTION

The present invention relates to logical toys and puzzles.

A logical toy is known, which includes a support composed of two coaxial layers with slots, and logical game elements formed as balls. The elements are arranged in the slots of the support so as to form game layers. The elements can displace along the slots and turn together with the layers of the support. The game involves arranging the elements in a predetermined position by turning together with the layers of the support and displacing along the slots. This logical toy is disclosed in the U.S. Pat. No. 5,172,912. The disadvantage of this toy is that there are no marks on the support which determine and fix the initial position and any predetermined positional of game elements, and the game elements formed as balls are different from one another only by their colors, while their mutual location and location of the disks therebetween is not fixed and not important. This reduces the attractiveness and gaming feature element of the toy.

Another logical toy is known, which includes a support composed of two coaxial layers with the slots, and game elements. The elements are arranged in the slots of the supports so as to form game layers. The elements can turn in the layers and turn together with the layers. Such a logical toy is disclosed in the patent of the Soviet Union no. 1,319,886. The construction disclosed in this reference has the following disadvantages:

there are no roundings (radii) or chamfers on the sides of the logical elements, and therefore playing with these elements is difficult and practically impossible since the elements which move toward one another are stopped by their corners when even an insignificant non-coincidence of touching surfaces takes place, and the presence of a great number of logical elements in the toy makes the probability of stopping close to 100%;

the logical elements do not have fixators of their position and therefore playing with such a toy is inconvenient and tiring, and a player must monitor all the time the correct location of the elements therebetween, and to provide correction of the location, since otherwise the toy will not turn;

the surfaces of the logical element do not have distinguishing marks, pictures, relieves or simple openings or slots for special inserts, and therefore their use in the toy is limited, the toy is less attractive and it can not be used by people with certain physical disadvantage, for example by blind people;

the coaxial layers or disks do not have distinguishing marks, therefore the toy is also less attractive similarly to the toy of U.S. Pat. No. 5,172,912.

A logical toy based on a similar principal is disclosed in the patent of the Soviet Union no. 1,806,810. The toy disclosed in this reference has the following disadvantages:

the logical elements are used not in accordance with their direct objective, but as carriers of other logical elements, which reduces the attractiveness of the toy, makes it more complicated because of a great number of turning and displacing elements;

the sides of the carriers of the logical elements do not have roundings or radii, or chamfers and therefore playing with the toys of these elements are complicated and practically impossible since the elements which move toward one another are stopped by their corners even with insignificant non-coincidence of the touching sides, and the presence of the great number of the elements in the game makes the probability of stopping close to 100%;

the fixators of position of the carriers of toy elements are located on the rigid or less elastic part of the arc, so that the fixation of the carriers of the toy elements is complicated;

two main layers do not have guides for coaxial relative turning, which causes stopping of the layers during the turning;

two main layers or disks are subdivided into four separate parts which are assembled only in the center due to the joint semi-axes and are supported only in the center and only by the semi-axis, while the fixators of the parts of the disks are located on the remote and less rigid distance from the axis of rotation, which not only makes the game difficult but actually makes it practically impossible, since the parts of the disks are not fixed with one another during turning, and can not be located in the same plane during turning without a special support;

the inner surfaces of the arcs which surround the supports of the toy elements do not have a radius, which leads to stopping of individual parts of the disks with the supports of the toy elements during their meet during training.

The construction which is close to the present invention is disclosed in U.S. Pat. No. 4,881,738. The toy disclosed in this reference has two parallel plates which are mounted with the possibility of turning around a common axis. The plates are spring-biased relative to one another, they have fixators of the position of turning, open arcs for turning and holding the toy elements. The arcs have projections for fixation of the position of the turning of the toy elements. The toy elements are formed as ⅙th of a cylinder with collars at both sides. The surface of the toy elements has marks, and the surface of the collars has flat area for fixing of the position of turning of the toy elements. This construction, however, also has some disadvantages, in particular:

all logical elements turn around a common axis of the toy around the same radius, or in otherwords there is only one toy layer, so that it is not possible to diversify the toy and change its logical complexity, and therefore its attractiveness is reduced;

there are no marks of position of the toy elements relative to the disks and no marks of position of the disks relative to the other disks, which reduces the attractiveness of the toy since the position of the toy elements relative to the disks is not fixed, and the position of the disks relative to each other is not fixed as well;

the orientational groups of toy elements on the base is fixed, and formed as a torus and can not be changed for example to form a square, a cross, a triangle, or a polygon, which also reduces attractiveness and the possibility of diversification of the toy;

there is no additional space beyond the groups of the toy elements, or in other words outside, and therefore the turning of the plate is not comfortable since fingers must turn the plates with touching of the arcs or toy elements and not the plates which must be turned, at a greater distance than if they touched the plates;

there is no additional space beyond the groups of the toy elements or in other words outside and therefore the attractiveness is reduced since there is no space for placing additional elements such as marks of color and drawings to increase its attractiveness or to provide additional functional properties, such as a therapeutic effect during playing (for example massaging plates) and compact design-to obtain greater attractiveness, convenience, development of logical thinking and spacial imagination in an analogous volume of the toy;

the plates do not have marks which determine their mutual position, which make the known toy less attractive, since the plates after the assembly of the toy can not be oriented in any order and not only in the initial order before playing the toy which reduces interest to the toy;

the toy uses two plates which have a different construction and therefore two molds are needed or one mold for two different disks, which increases the cost of the toy;

the known toy uses two plates formed as disks, the plates can not be formed for example as triangles or polygons, which reduces its attractiveness.

SUMMARY OF THE INVENTION

Accordingly, it is an object of the present invention to provide logical toy which avoids the disadvantages of the prior art.

More particularly, it is an object of present invention to provide a logical toy of the above mentioned type which increases comfort and attractiveness of playing a toy, provides the use of new functional properties such as for example therapeutic properties and properties for development of a logical thinking and spacial imagination, as well as the ability to be used by people having handicaps for example blind people.

In keeping with these objects and with others which will become apparent hereinafter, one feature of present invention resides, briefly stated, in a logical toy which has two coaxial, spring-biased parallel plates formed as disks which are concentrically turnable about a common axis and are provided with arcs, a plurality of toy logical elements surrounded by the arcs and turnable inside the arcs, the toy logical elements being formed as parts of a cylinder, one of the plates having an inner surface provided with a ring-shaped passage with depressions for fixing of a mutual turning of the plates, the other of the plates having an inner surface provided with ring-shaped projection corresponding to a diameter of the ring-shaped passage and having spherical projections, the ring-shaped projections having a height which is greater than a height of spherical projections, the ring-shaped passage with the depressions and the ring-shaped projection with the spherical projections being located concentrically to the axis of turning of the plates at the minimal distance from the axis, the arcs and the inner surfaces of the plates having a common sides provided with radii, the inner surfaces of the arcs having fixators of position of the toy logical elements which are formed as transverse slots, the plates being provided with setting openings, a movable and immovable attachments pressed-in the setting openings, massaging attachments and further attachments pressed in an outer surface of the plates, inserts in the further attachments, the axis of rotation of the plates having one end provided with a head and another end provided with a collar formed with inclination from a smaller diameter at a base of the axis to a greater diameter closer to a center of the axis, the axis of turning being provided with at least one longitudinal slot.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 2:
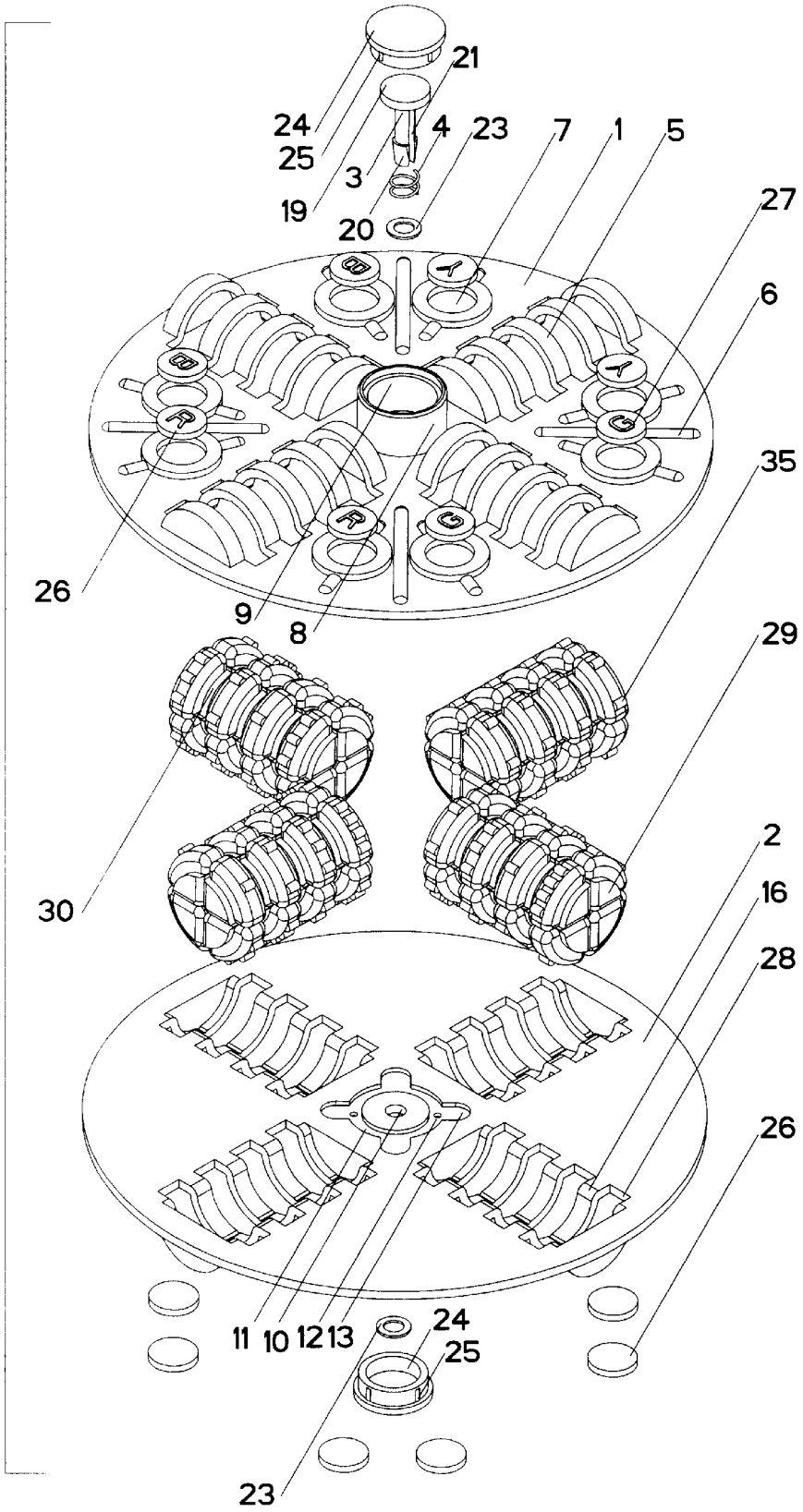
FIG. 2 is an exploded view of the inventive logical toy.

A toy in accordance with the present invention as shown in FIG. 2 has two plates 1 and 2 which are arranged on the same axis 3 and string-biased by a spring 4. The outer surface of the plates has arcs 5, reinforcing ribs 6, stepping openings 7 and a central projection 8 with the openings 9 and 10. The inner surface of the plate 2 has a ring-shaped passage 11 with stepping openings 12 and depressions 13 for fixation of a relative turning of the plates.

Figure 17:
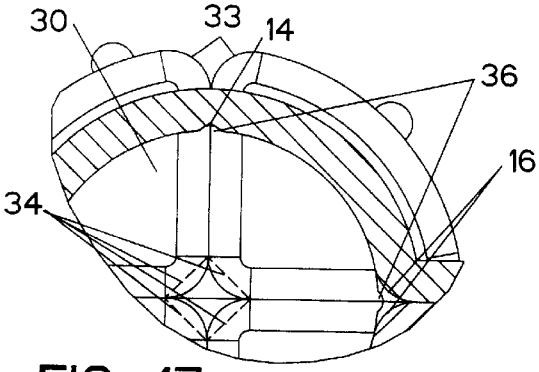
FIG. 17 is a detailed scaled view F of FIG. 14 as shown in an example of fixation of toy logical elements having projections on the arcs with depressions.
Figure 18:
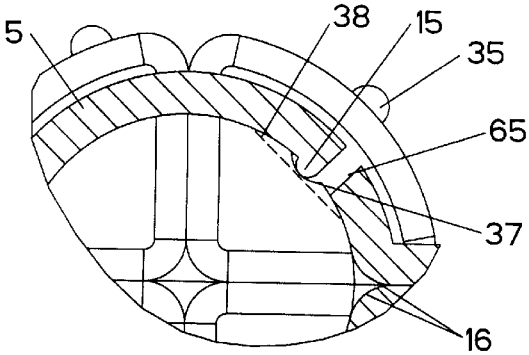
FIG. 18 is a detailed scaled view F of FIG. 14, with an example of fixation of toy logical elements have depression on the arcs and having projections and cubs.

The inner surface of the arcs 5 have a transverse slots 14 or transverse projections 15 as shown in FIG. 17,18, 33, 36. Common sides of the arcs 5 and the inner surface of the plates 1 and 2 have radii 16 or chamfers as shown in FIGS. 2, 17 and 18.

Figure 13:
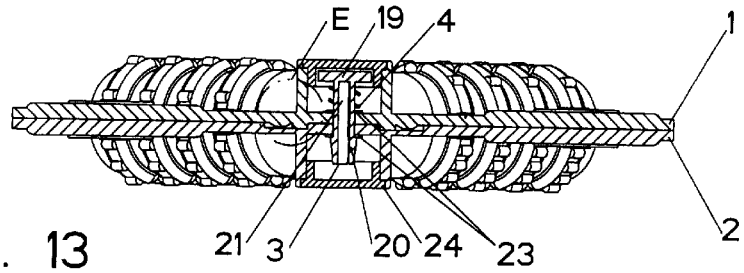
FIG. 13 is a view showing a full section B—B in FIG. 5.
Figure 15:
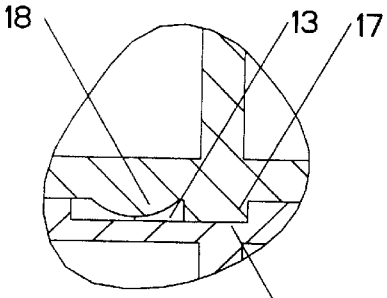
FIG. 15 is a detailed scaled view E of FIG. 13.
Figure 16:
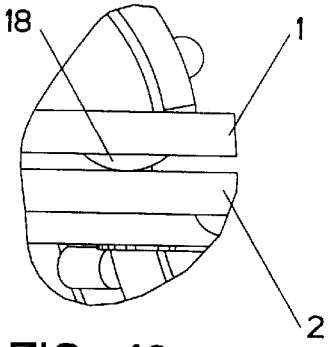
FIG. 16 is a detailed scaled view D of FIG. 10.
Figure 33:
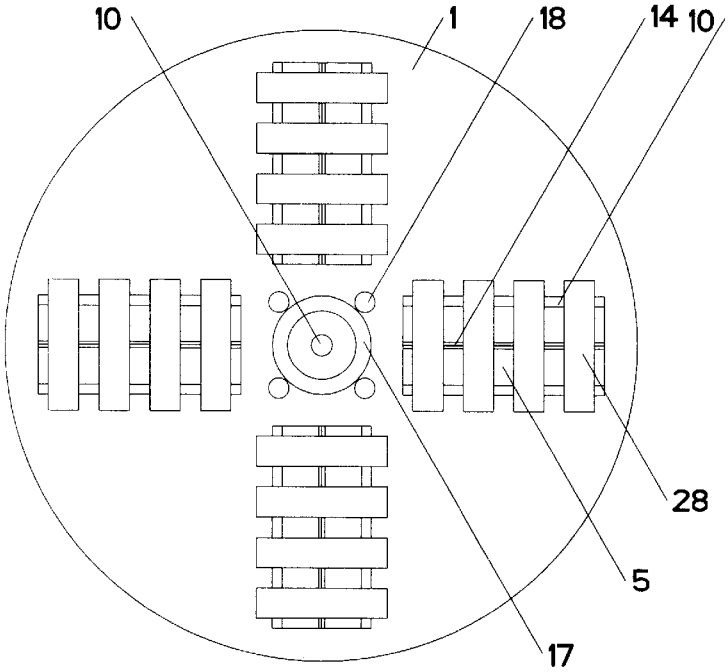
FIG. 33 is a view showing the same from below.

The inner surface of the plate 1, instead of the ring-shaped passage 11 has a ring-shaped projection 17, and instead of the depression 13 has spherical projections 18 shown in FIGS. 15, 16, 33. The height of the ring-shaped projection 17 is greater than that of the spherical projection 18. The axis 3 has a head 19 at one end, and at the other end has a collar 20 formed with an inclination from a small diameter at the base of the axis 3 to the greater diameter at the center of the axis. The axis 3 has at least one transverse slot 21. The slot 21 imports to the axis 3 springy or elastic property and is necessary for a fast assembly of the plate of the toy which makes the toy assembly less expensive and reduces its costs, as can be seen from FIGS. 2, 13.

Figure 3:
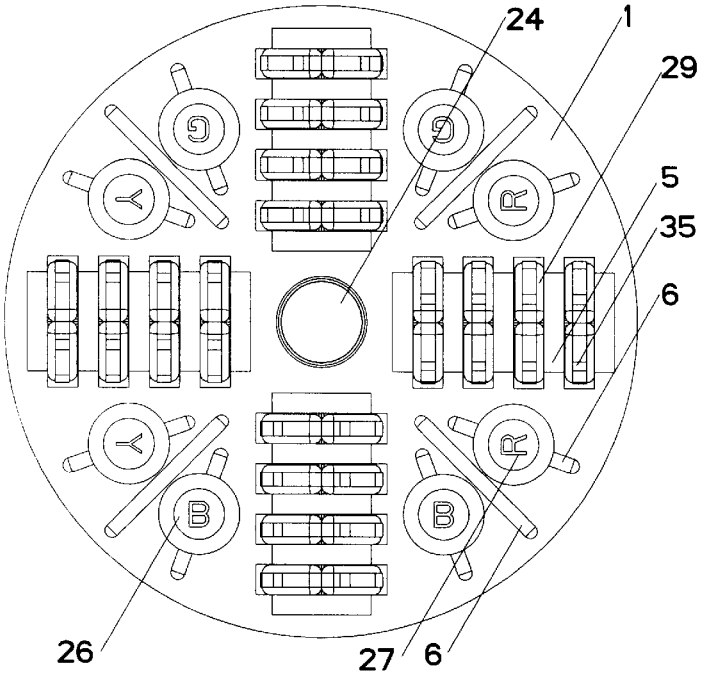
FIG. 3 is a view showing a logical toy from above with logical elements with marks arranged in accordance with the sequence I, II, III and IIII, the plates are arranged relative to one another in accordance with the color marks.
Figure 4:
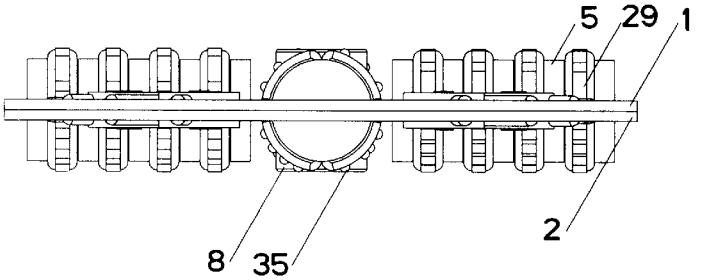
FIG. 4 is a similar view but as seen from the front.

The central assembly of the toy as shown in FIGS. 2 and 3, has, in addition to the axis 3, a spring 22, two washers 23 and two plugs 24 with formations 25. The formations 25 provide optimal conditions for pressing of the plugs 24 in the opening 9 and pressing them out. The spring 22 is located between the head 19 on the axis 3 and the washer 23 on the outer surface of one of the plates 1 or 2. The other washer 23 is located on the outer surface of the other plate 2 or 1 and the collar 20 of the axis 19. The inserts 26 with marks of color 27, symbols or reliefs are located in the opening 7 and the outer surface of the plates 1 and 2. The arcs 5 of the plates 1 and 2 are separated by slots 28. Logical elements 29 as shown in FIGS. 1, 2, 3, 4, 5 are located in the slots 28.

The radii 16 provided on the arcs 15 are important since they influence the displacement of the plates 1 and 2. When there is no radii, the probability of stopping of the plates 1 and 2 during turning is increased. This can be explained by the fact that the logical element 29 during jiggles and free play, being located on the plates 1 and 2 have a possibility of abutting against the surfaces of the arcs 5 and to stop the neighboring plate 2 or 1. If instead of the sides the radius 16 is formed, the stopping is prevented since the logical elements 29 will slide along the radii 16.

The logical element 29 can be formed as a part of the cylinder, for example ½, ¼, ⅙th etc. Collars 30 are provided at both sides of the logical element as shown in FIGS. 39B, 40A, 40B, 41 which are formed independently from the outer shape of the logical element as a part of the cylinder. The front surfaces of the logical element are provided from both sides with a radius 31 shown in FIGS. 40A, 40B, 41, 42. The radii 31 can be replaced by chamfers. The surfaces of the collars 30 at the base are rounded from both sides, since they have radii 32 shown in FIG. 40A, 40B, 41, 42. The radii 32 can be replaced with chamfers.

The surfaces which are formed by section of the cylinder, or (main surfaces of the logical element) are rounded from both sides by radii 33, and are rounded by radii 34 shown in FIGS. 39A–40C, 41–43. Both the radii 31 and 32 and the radii 33 and 34 can be replaced with the chamfers as shown in FIG. 17 (hidden lines for radius 34 for example). However, the use of the radii instead of the chamfers is advantageous, since this makes the displacement of the logical elements in the toy smoother without jumps and stops.

Figure 42:
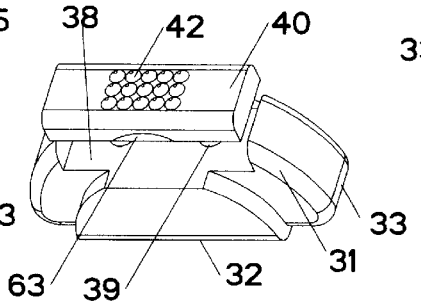
FIG. 42 is a view showing a toy logical element formed as one half of a cylinder, with a massaging insert and fixator on an arc on the form of a flat surface, on a perspective view.
Figure 43:
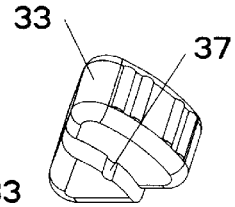
FIG. 43 is a view showing a toy logical element formed as ⅙th of a cylinder, on a perspective view.

A relief 35 formed by a number of marks or lines can be provided by the outer surfaces of the logical element as shown in FIGS. 39A, 40A, 40B, 40C, 40D, 41,42,43. They can be used both forthe logical ordered location of the elements between themselves during playing with the toy, for example to arrange the elements in the order I, II, III, IIII, and for playing by touching for example by blind users. The collars 30 or at least one collar from at least one side of the logical element, have fixators of positional elements formed as projections 36 or depressions 37 shown in FIGS. 33B, 41, 43. The logical element can have a front slot formed as a rectangle 38 shown as FIG. 42. The base of the slot 38 which is located below the upper point of the collar can serve as a fixator of location of the logical element as shown in FIG. 42. The base of the slot 38 can be provided with at least one setting opening 39 shown in FIG. 42. The front slot 38 can be formed as any shaped slot, open and not closed, at the apex of the logical element.

Figure 44:
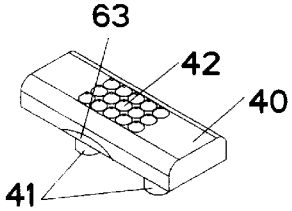
FIG. 44 is a view showing a massage insert on a perspective view.

The front slot 38 makes possible to use the inserts 40 shown in FIG. 42 which are provided for broadening of functional and playing possibilities of the logical element. The inserts 40 as shown in FIG. 42 and 44 have setting projections 41 which make possible pressing of the inserts into the openings 39 located at the base of the slot 38 as shown in FIG. 42. The inserts 40 can be provided with massaging projections 42 for action on narrow points of fingers during displacement of the logical elements as shown in FIGS. 42, 44. The inserts and the logical elements can be provided with a release 35, drawings 43 or numbers 44 as shown in FIGS. 24, 25, 26, 27. They diversify the toy, develop logical thinking, spacial imagination, sensitivity of fingers, etc.

Figure 28:
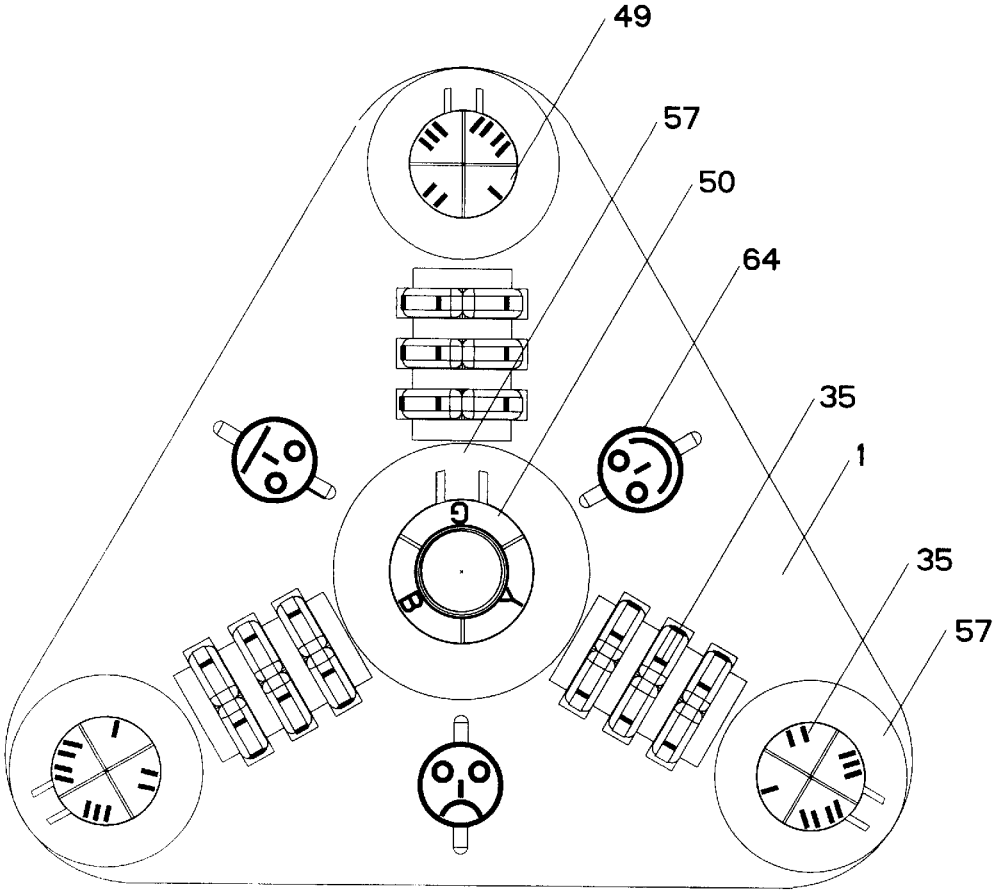
FIG. 28 is a view showing an inventive toy with groups of toy elements located along a triangle, with the plates formed as a triangle, with turning toy marks of color located coaxially with the plates with turning marks of symbols of groups of toy elements, located at the corner of the triangle, and with symbols-marks of the plates relative to one another.
Figure 29:
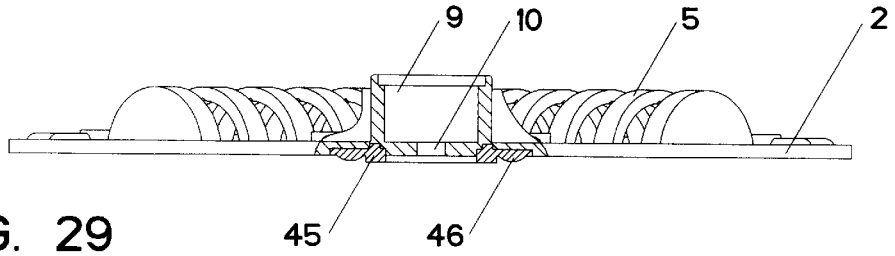
FIG. 29 is a view showing a female plate or disk with an insert in assembled condition, from the front with a local cross-section.
Figure 30A:
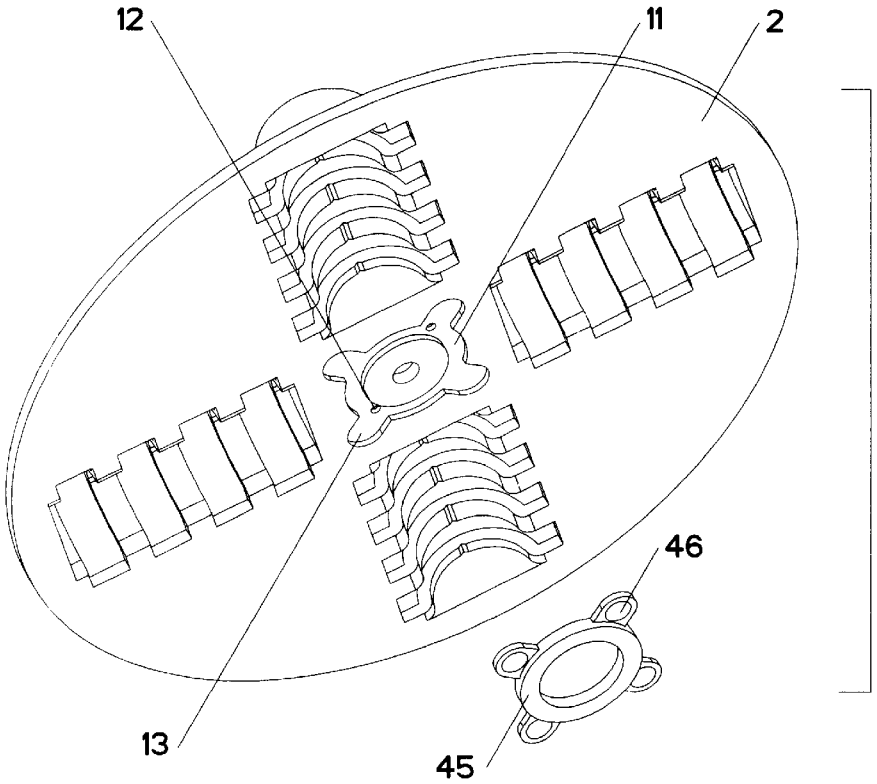
FIG. 30A shows the same on an exploded view in perspective from below.
Figure 30B:
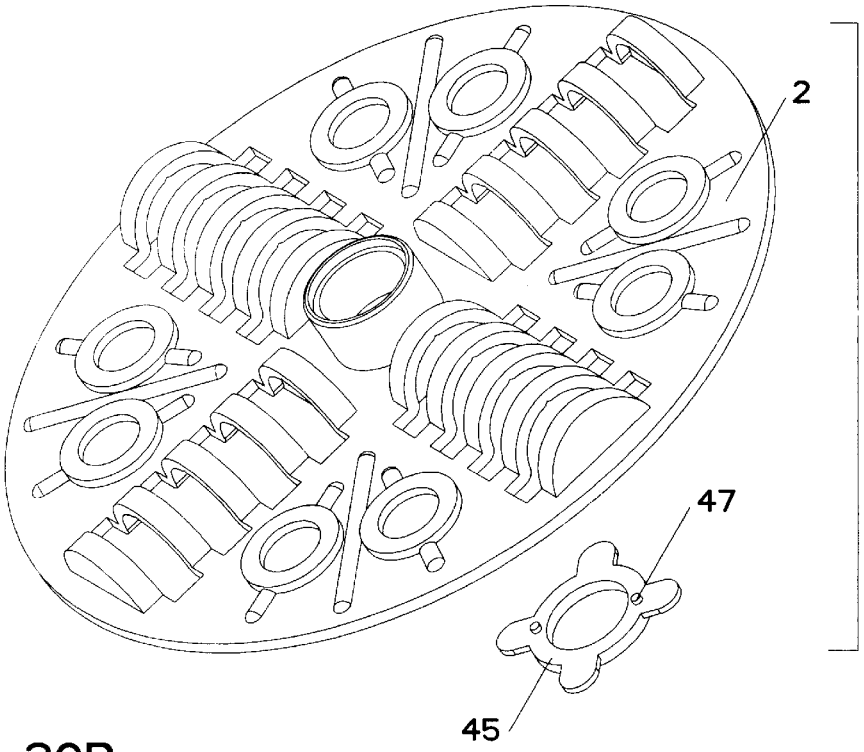
FIG. 30B is a view showing the same on an exploded view in a perspective from above.
Figure 31:
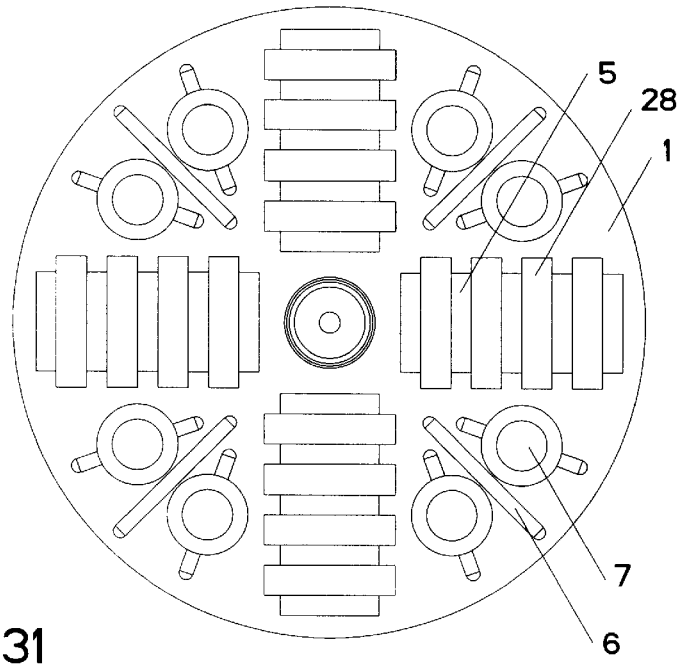
FIG. 31 is a view showing a male disk from above.
Figure 32:
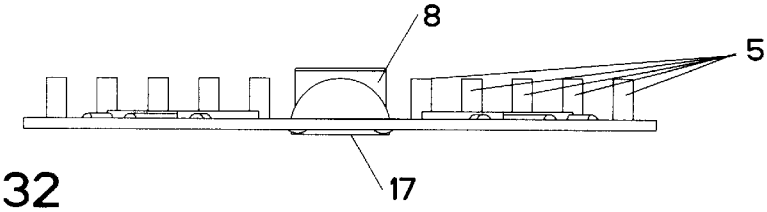
FIG. 32 is a view showing the same from the front.
Figure 34:
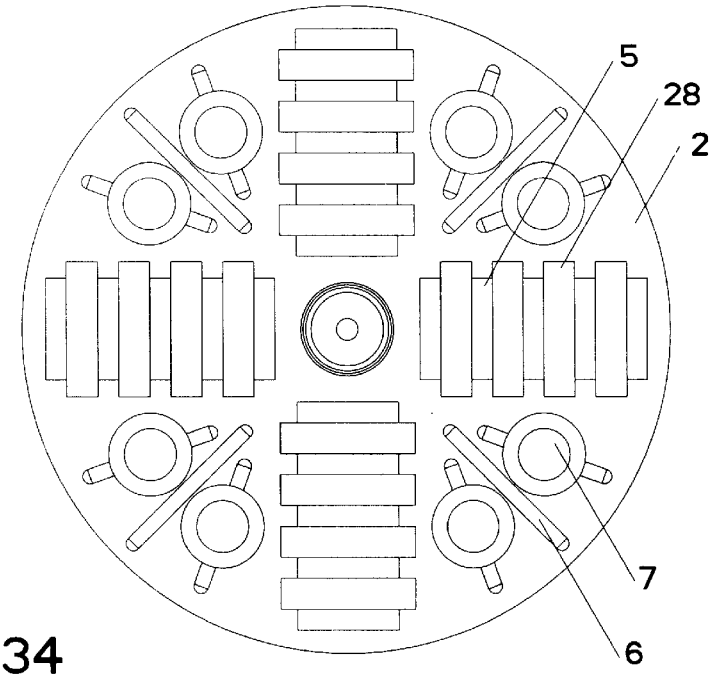
FIG. 34 is a view showing an example of a female plate or disk from above.
Figure 35:
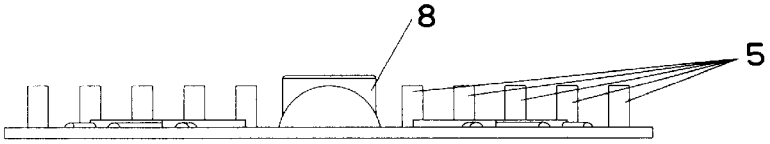
FIG. 35 is a view showing the same from the front.
Figure 36:
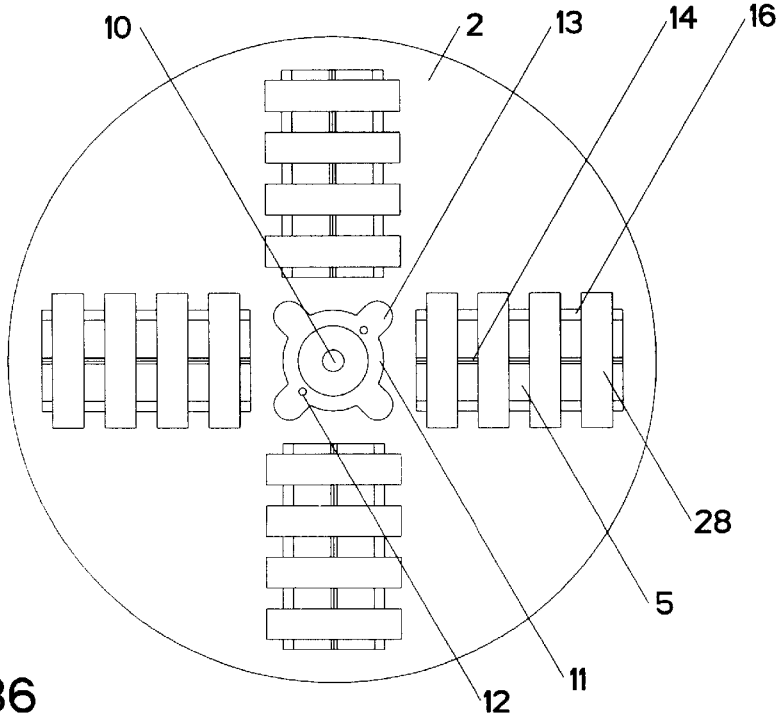
FIG. 36 is a view showing the same from below.
Figure 37:
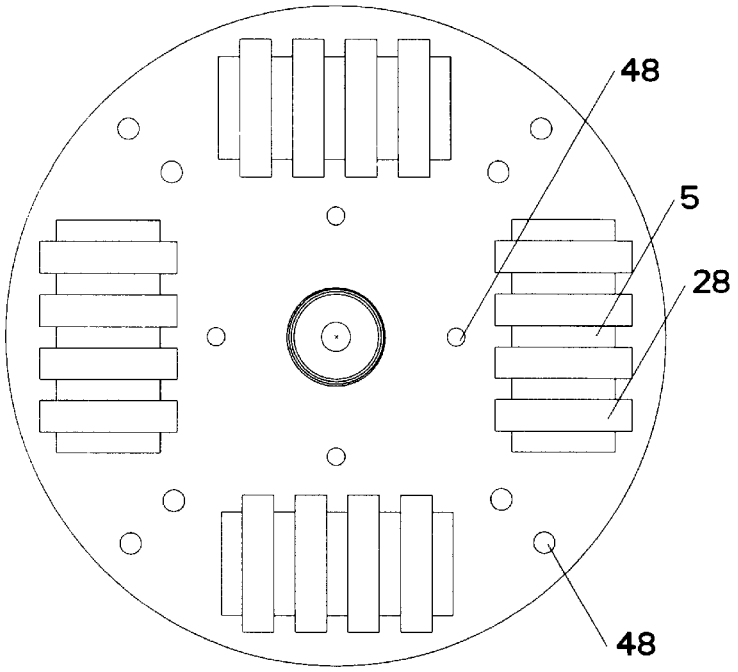
FIG. 37 is a view showing a disk of FIG. 23 without toy elements, turning marks and massaging attachments but with mounting holes, from above.
Figure 38A:
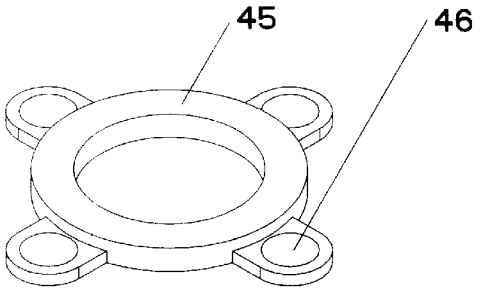
FIG. 38A is a view showing an insert in a perspective, from above.
Figure 38B:
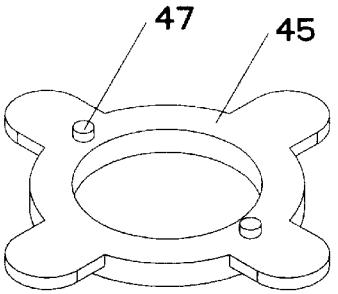
FIG. 38B is a view showing a same from below.
Figure 38C:
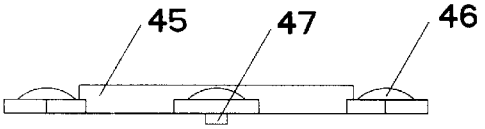
FIG. 38C is a view showing the same from the front.
Figure 39A:
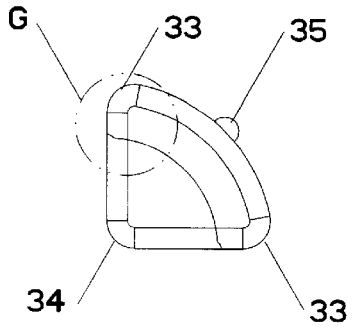
FIG. 39A is a view showing a toy logical element formed as one quarter of a cylinder, from the front.
Figure 39B:
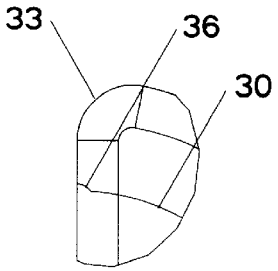
FIG. 39B is the same but showing the view G in view FIG. 39A, on a scale.
Figure 40A:
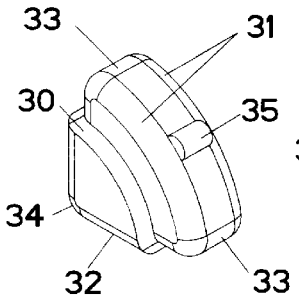
FIG. 40A is a view showing the same on a perspective view with one line (relief, mark) on the surface.
Figure 40B:
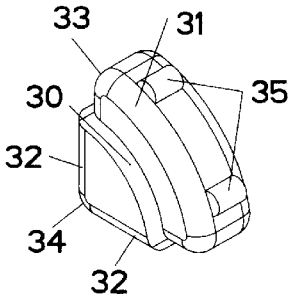
FIG. 40B is a view showing the same with two lines (relief, mark) on the surface.
Figure 40C:
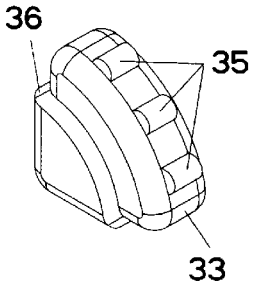
FIG. 40C is a view showing the same with three lines (relief, mark) on the surface.
Figure 40D:
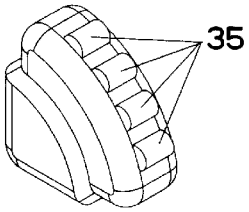
FIG. 40D is a view showing the same with four lines (relief, mark) on the surface.
Figure 41:
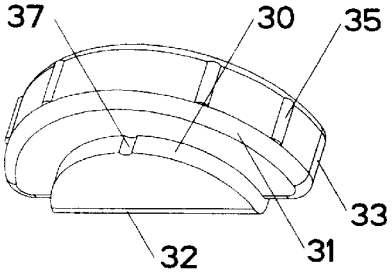
FIG. 41 is a view showing a toy logical element formed as one half of a cylinder, on a perspective view.

As explained above, the toy uses two plates, namely the plate 1 which is a male plate with a ring-shaped projection 17 and a spherical projection 18 shown in FIG. 31–33, and a plate 2 which is a female plate with a ring-shaped passage 11, setting openings 12 and depressions 13 as shown in FIGS. 34–36. It is possible to use in the toy two plates 2 which are female plates, but with the inserts 45 as shown in FIGS. 30A, 30B. This makes possible to reduce the cost of the toy due to reduction of the number of molds. In order to maintain the functional properties of the toy, one of the plates 2 which is a female plate must be converted into the plate 1 which is a male plate. For this purpose, an insert 45 is used which has the shape of a ring-shaped passage 11 and depressions 13 of the plate 2 which is a female plate) with spherical projections 46 and setting projections 47 shown in FIGS. 38A–38C. The insert 45 is pressed into the setting openings 12 by the setting projections 47. The plate 2 which is a female plate together with the pressed-in insert 45 is converted into an exact copy of the plate 1 which is a male plate, as shown in FIGS. 29, 30A, 30B. The plates 1 and 2 can be formed as disks shown in FIGS. 1–12, 23, 24, 26, 27, 29, 30A–37, and also as a square shown in FIG. 25 or a triangle shown in FIG. 28. The shape of the plate in this common case can be formed as any polygon.

Figure 1:
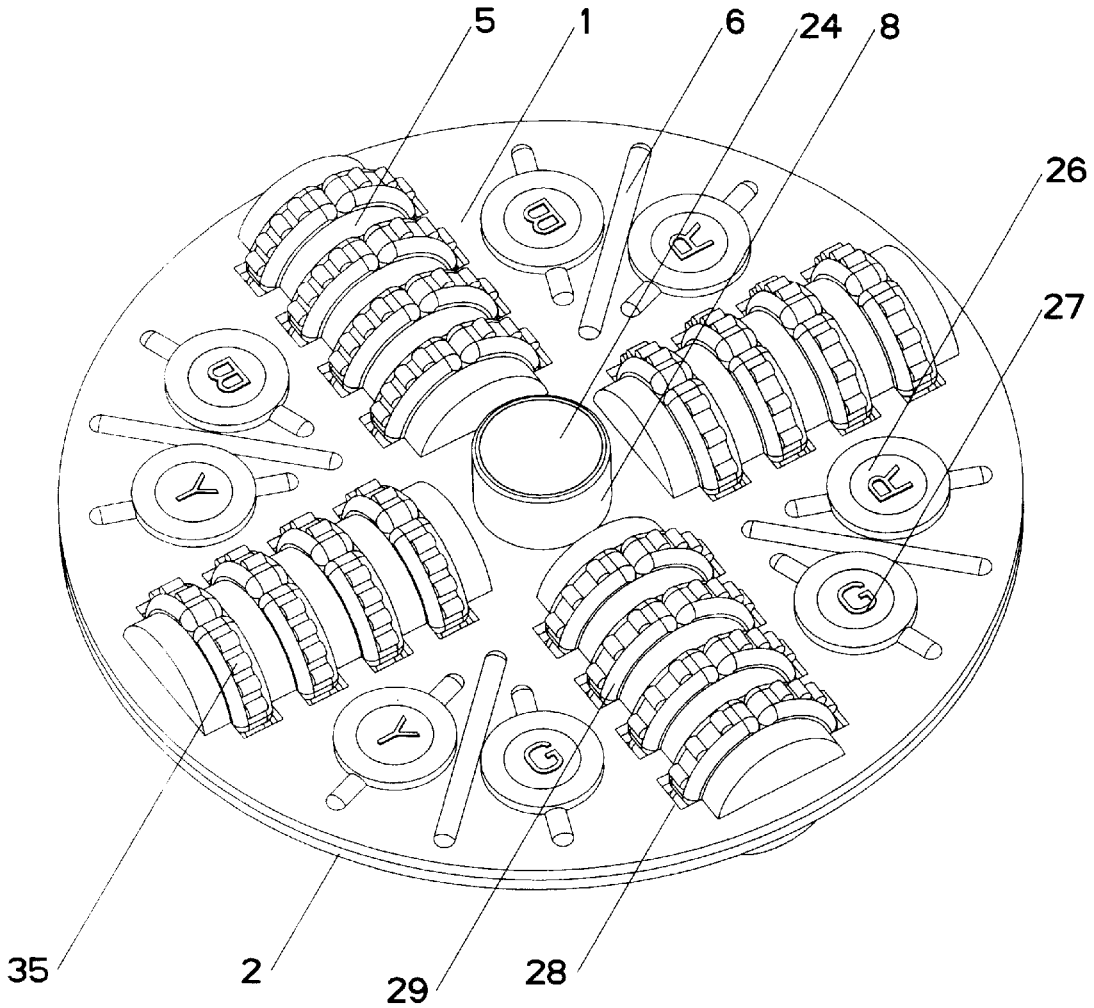
FIG. 1 is a view showing a logical toy in a perspective view in accordance with the present invention.

The reinforcing ribs 6 on the outer surfaces of the plates 1 and 2 impart them additional rigidity as shown in FIG. 1. They are desirable but not absolutely necessary.

Figure 10:
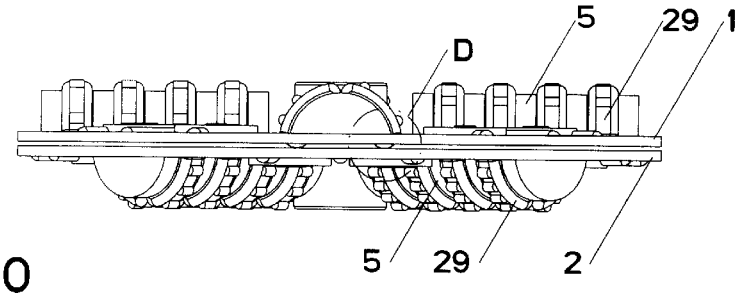
FIG. 10 is a similar view but as seen from front.
Figure 11:
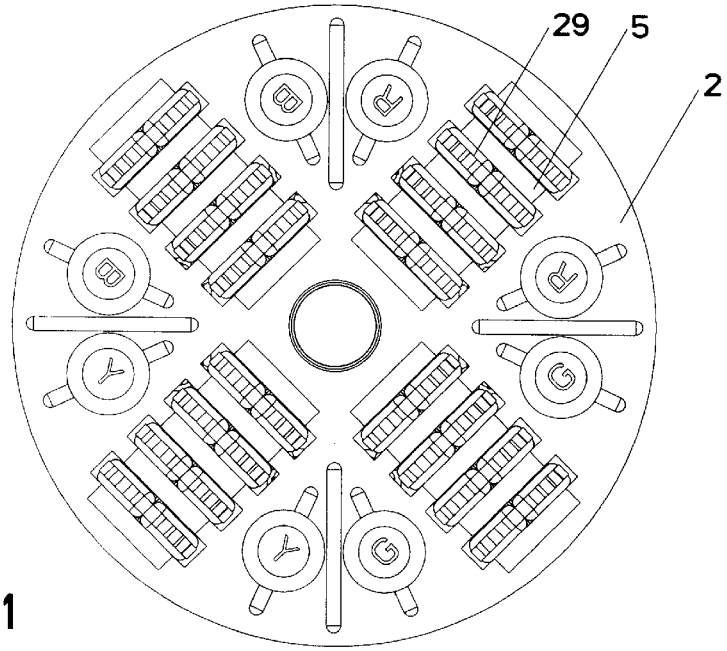
FIG. 11 is a similar view but from below.
Figure 12:
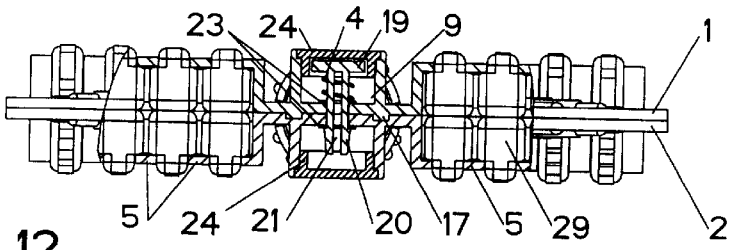
FIG. 12 is a view showing an inventive logical toy in accordance with a local section A—A in FIG. 5.

The depression 13 interacting correspondingly with the spherical projections 18 on the inner surfaces of the plates 1 and 2 must be located at the most rigid spot of the plate, for example between the axis 3 of the toy and the groups of the toy logical elements 29 at a distance close to the axis 3 of the toy as shown in FIG. 36. This provides for a more accurate and clear fixation of a relative displacement of the plates 1 and 2, since the location of the fixing elements at the closed distance to the axis excludes a possible non-parallel location and non-plane location of the plates 1 and 2, which increases with the distance of the axis of turning of the plates. In addition, the force of compression of the spring 4 in the plates of fixation of location of the plates 1 and 2 is controlled to a maximum degree by the spring 4 and does not depend from the sizes of the plates 1 and 2. Analogously, the ring-shaped passage 11 and the ring-shaped projection 17 or insert 45 must be arranged at a distance close to the axis 3 as shown in FIG. 15, 33. The plates 1 and 2 will turn coaxially, without eccentricity due to the interaction of the ring-shaped projection 17 of the insert 45 with the ring-shaped passage 11, which also influences the accuracy of turning of fixation of the plates 1 and 2 among themselves as shown in FIG. 10. The height of the ring-shaped projection 17 must be more than the height of the spherical projections 18 in order to provide a constant engagement of the ring-shaped projection 17 with the ring-shaped passage 11, which is necessary for coaxial turning of the plates 1 and 2.

The inserts 26 with the marks of color (symbols, reliefs) 27 identify both the location of the groups of the toy logical elements 29, and the mutual location of the plates 1 and 2. The inserts 26 with the marks 27 are formed permanent, non-removable and immovable. They are pressed-in or glued in the openings 7 shown in FIGS. 1 and 2.

Figure 48:
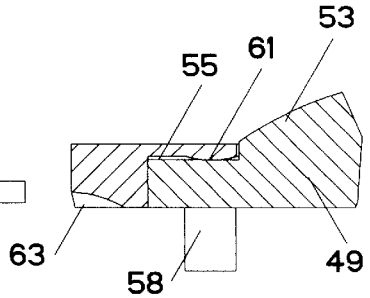
FIG. 48 is a view showing a detailed scaled view H on FIG. 47B.

However, for a substantial increase of attractiveness of the toy and its therapeutic properties, the plates 1 and 2 can be provided with setting openings 48 shown in FIG. 48 for mounting of a movable turning inserts 49 and 50 shown in FIGS. 23–28, and also removable massaging attachments 51 and 52 with massaging projections 42 and setting projections 41 can be provided as shown in FIG. 44.

Figure 45:
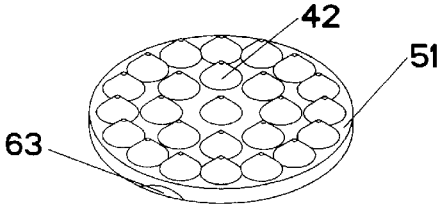
FIG. 45 is a view showing a massaging attachment, on a perspective view.
Figure 46A:
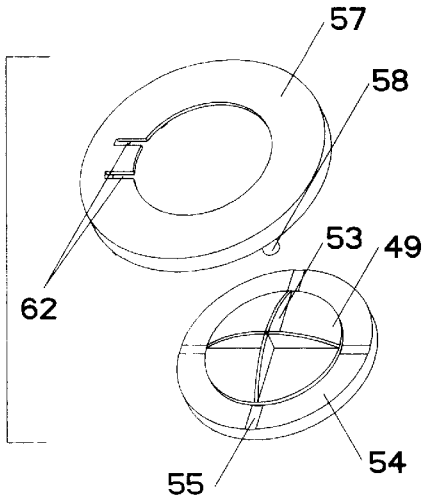
FIG. 46A is an exploded view of the attachment for turning insert and the turning insert from above on a perspective view.
Figure 46B:
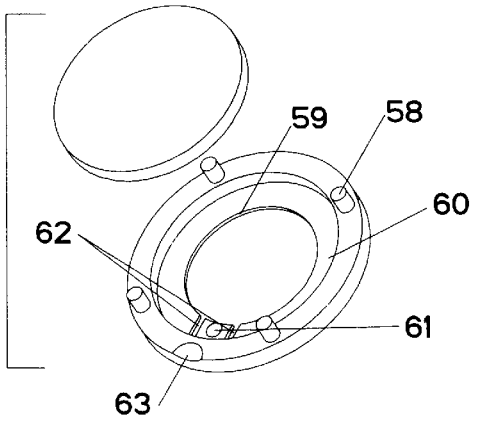
FIG. 46B is a view showing the same from below on a perspective view.
Figure 47A:
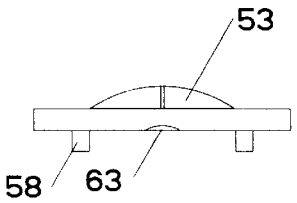
FIG. 47A is a view showing an attachment for a turning insert assembled with the turning insert, from the front.
Figure 47B:
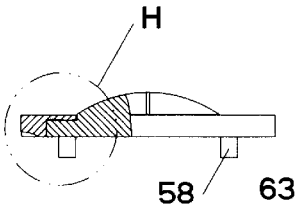
FIG. 47B is the view showing the same from the right side with a local cross-section.
Figure 49A:
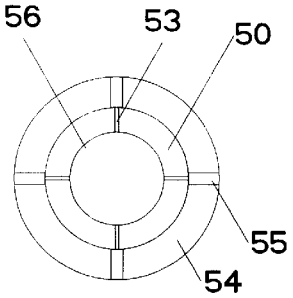
FIG. 49A is a view showing a turning insert with a central opening.
Figure 49B:
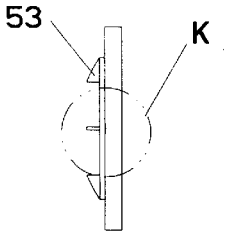
FIG. 49B is a view showing the same from the right side.
Figure 50:
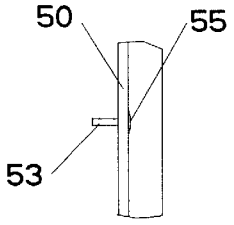
FIG. 50 is a view showing a detailed scaled view K of FIG. 49B.

A removable turning insert 49 is formed as a disk with ribs 53 for separation of the marks 27 and for convenience of turning. The insert 49 has a cylindrical lowering 54 with radially located grooves 55 for fixation of its turning, shown in FIGS. 46A–48, 50. The insert 50 is formed analogously to insert 49, however it has a central opening 56 which is necessary for a free passage of the central projection 8 of the toy shown in FIGS. 49A–50. The inserts 49 and 50 are located in the attachment 57 shown in FIG. 46A. The attachment 47 is formed as a disk with setting projections 58, a throughgoing opening 59, a cylindrical lowering 60, a spherical formation 61, two slots 62 and an undercut 63. The opening 59 is necessary for a free passage of the ribs 53 and marks 27 of the inserts 49 and 50. The inserts 49 and 50 are located in the attachments 57 and are jointly pressed in the setting openings 48 by the setting projections 58. A gap is provided between the lowerings 54 and 60. However, the turning insert 49 or 50 is pressed to the surface of the plate 1 or 2 by a spherical formation 51 shown in FIGS. 46B, 48, which has ability to spring due to the location of the slots 62 as shown in FIGS. 46A, 46B. The inserts 49 and 50 can be easily pressed out from the openings 48 and removed due to the undercuts 63 in the attachment 57 as shown in FIGS. 46B, 48. Instead of them, in the same openings 48, or other openings 48, massaging attachments 51 and 52 can be installed. They are removable, they have a setting projections 41 for easy pressing-in and an undercut 63, shown in FIGS. 44, 45 to simplify the removal.

Figure 23:
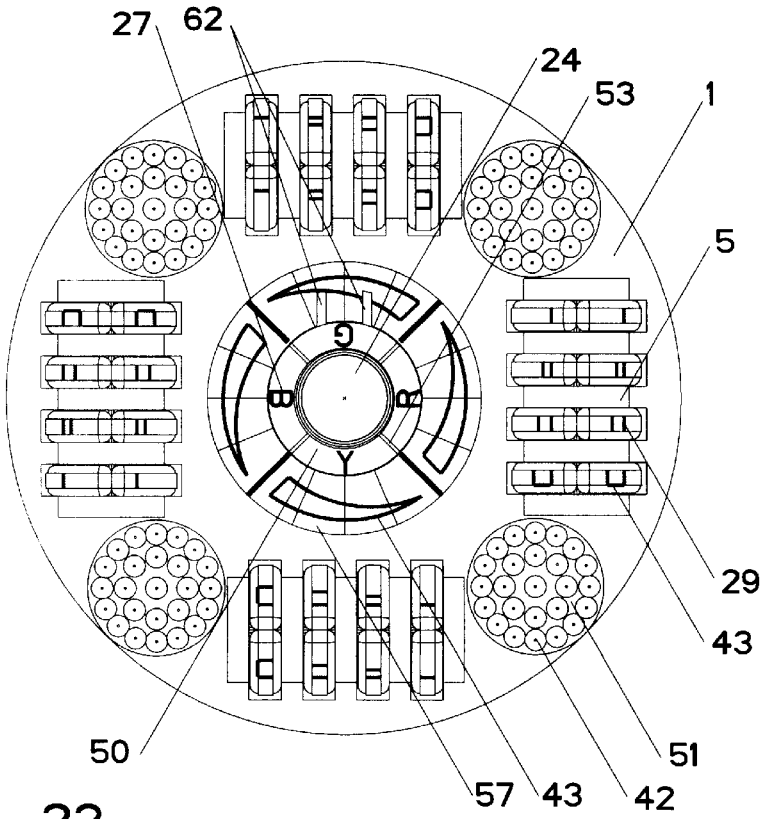
FIG. 23 is a view showing an example of the toy with groups of toy elements located in accordance with a square, with massaging attachments and turnable toy marks located coaxially with the plates.
Figure 24:
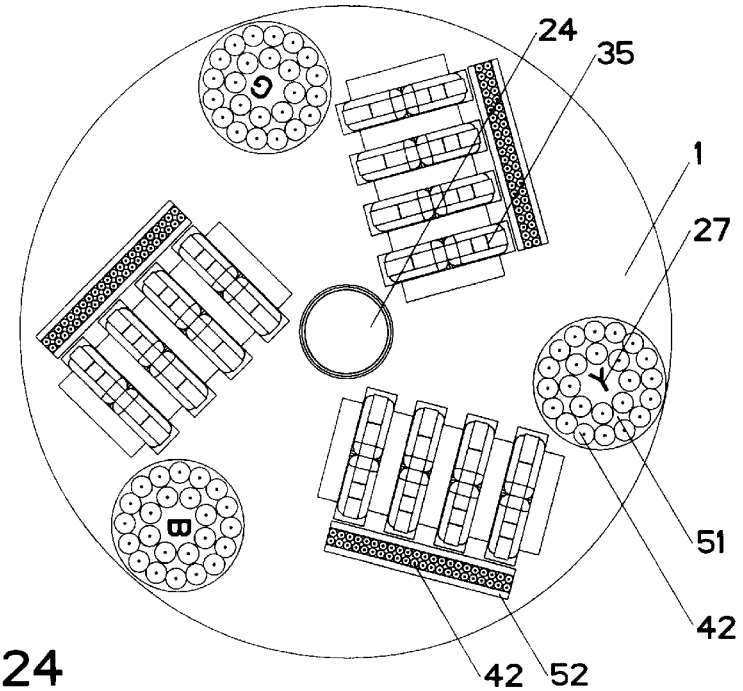
FIG. 24 is a view showing the inventive toy with groups of toy elements located at an angle, with massaging attachments near the base of each group of toy elements and with massaging attachments coinciding with the marks of a color of the groups of the toy elements.
Figure 25:
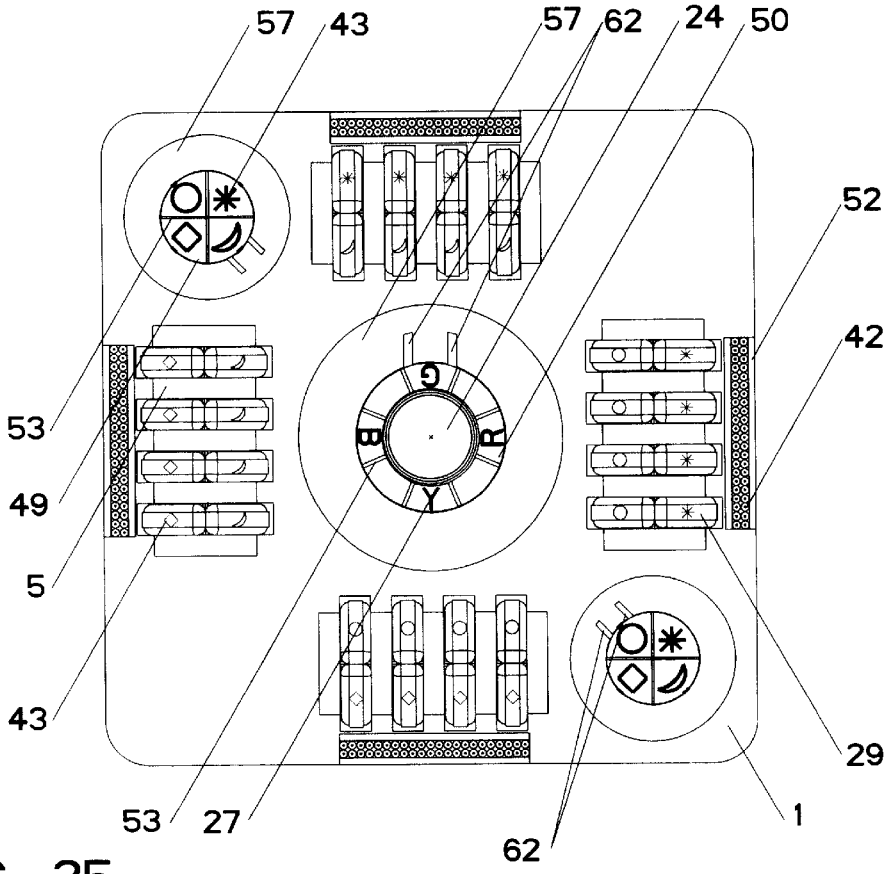
FIG. 25 is a view showing an inventive toy with groups of toy logical elements located along a square, with massaging attachments near the base of each group and with turning toy marks located coaxially with the plates and between the neighboring groups of elements, with the plates formed as square.
Figure 26:
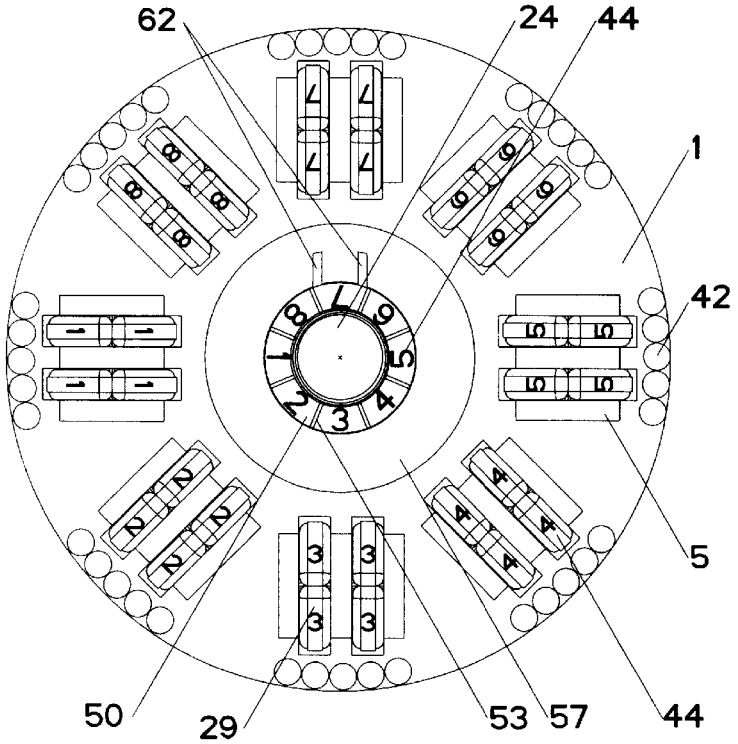
FIG. 26 is a view showing the inventive toy with groups of toy elements located in accordance with octahedrun and, with massaging attachments on the plates near the base of the toy elements and with turning toy marks located coaxially with the plates.
Figure 27:
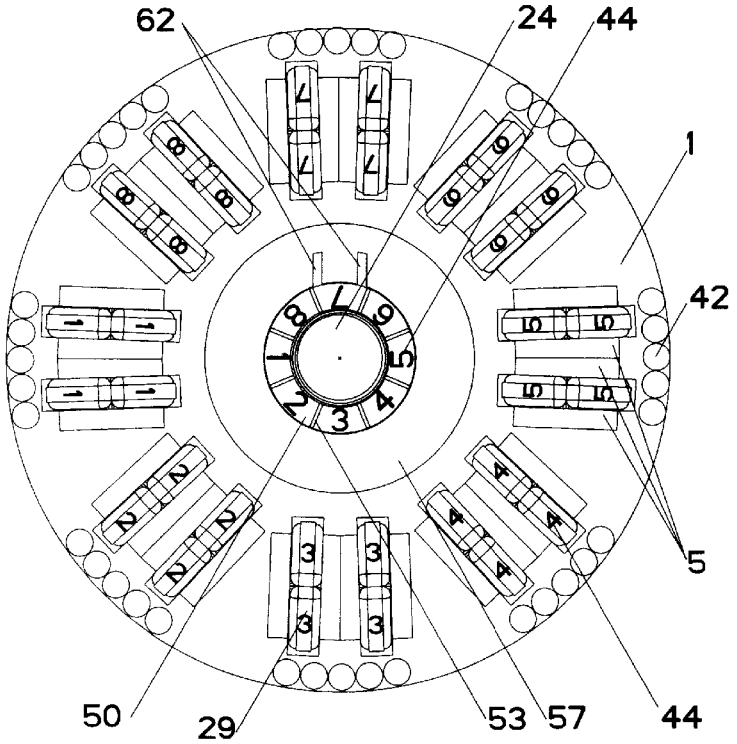
FIG. 27 is a view showing the inventive toy with groups of toy elements located along an octahedrun and along an arc of turning of the plates simultaneously, with massaging attachments on the plates near the base of the toy elements and with turning toy marks located coaxially with the plates.

The massaging attachment 51 and 52 are located in the places which are most convenient for massaging with fingers and provide maximum therapeutic effect during playing with the toy. For example the attachments 52 are preferably located at the base of the group of the toy logical elements 29, so that after turning of any of the elements 29, the fingers of a user can support against the massaging projections 42. The massaging attachments 51 are preferably located at the edge of the plates, so that a user can conveniently turn the plates and support with the fingers against the massaging projections as shown in FIGS. 23–25. Marks 27 shown in FIG. 24 can be formed inside the massaging attachments 51. They simultaneously convert the attachments 51 into identifying elements for identification of location of the groups of the toy logical elements 29 on the plates 1 and 2, and also for identifying the mutual location of the plates 1 and 2. The massaging projections 42 can be simultaneously formed with the plates 1 and 2 so as to locate them along the outer parameter of the plates 1 and 2 continuously and discretely, for example only at the base of the groups of the logical element 29. The discrete location of the massaging projections 42, provides a possibility of selection for a user: it can be supported with the fingers against the massaging projections 42 during turning of the disks or not as shown in FIGS. 26, 27. The massaging projections 42 can be replaced with massaging reliefs 64 formed as simple attractive symbols as shown in FIG. 28. These reliefs can be formed for identification of the mutual location of the plates 1 and 2 and designed together with them or separately from them. In other words they can be removable and located on the inserts, analogously to the massaging inserts 45.

In order to increase the springy properties of the arcs 5, they can be formed with the slots 65 shown in FIG. 18 . The slots increase the accuracy of fixation of the toy logical elements 29 on the arcs 5 due to the additional spring-biasing of the arcs 5 and compensation of the tolerances of the size of toy logical elements 29.

Figure 5:
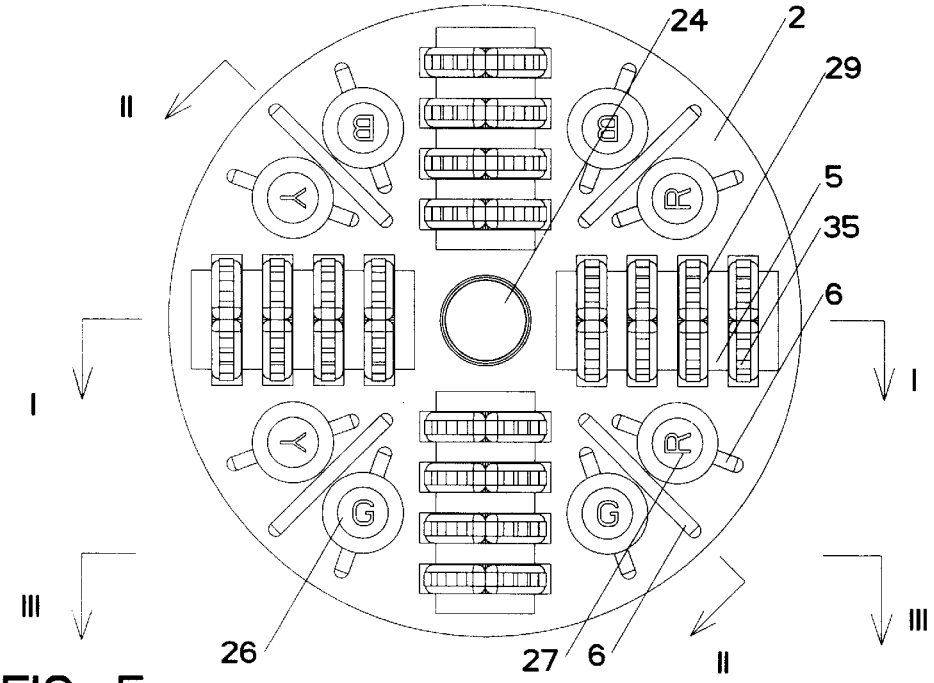
FIG. 5 is a similar view but as seen from below.
Figure 6:
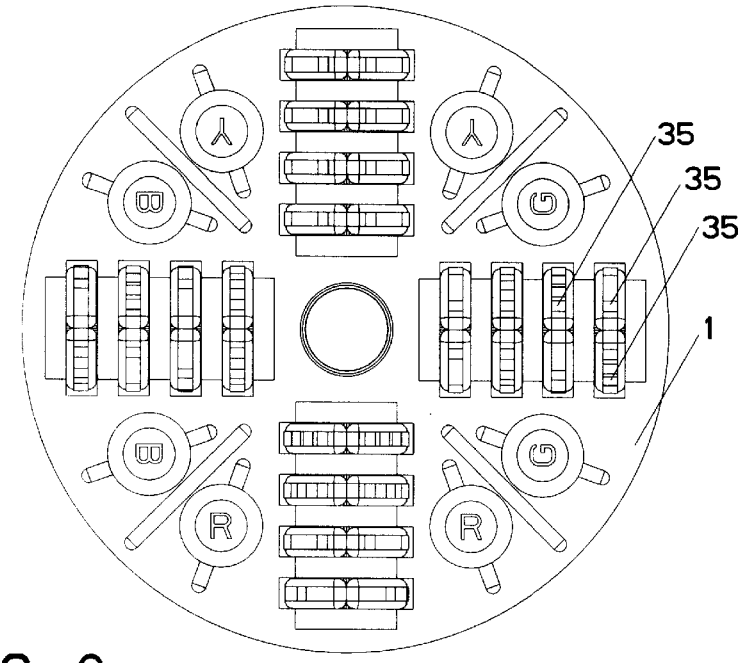
FIG. 6 is a view showing a logical toy from above with a toy elements with marks which are disordered, and the plates are turned.
Figure 7:
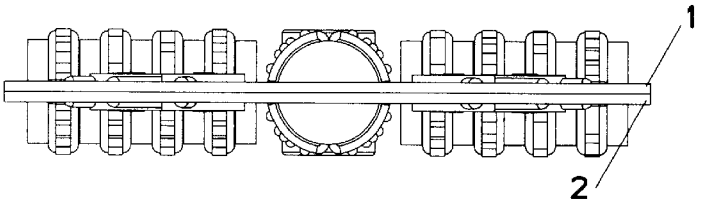
FIG. 7 is a similar view but from the front.
Figure 8:
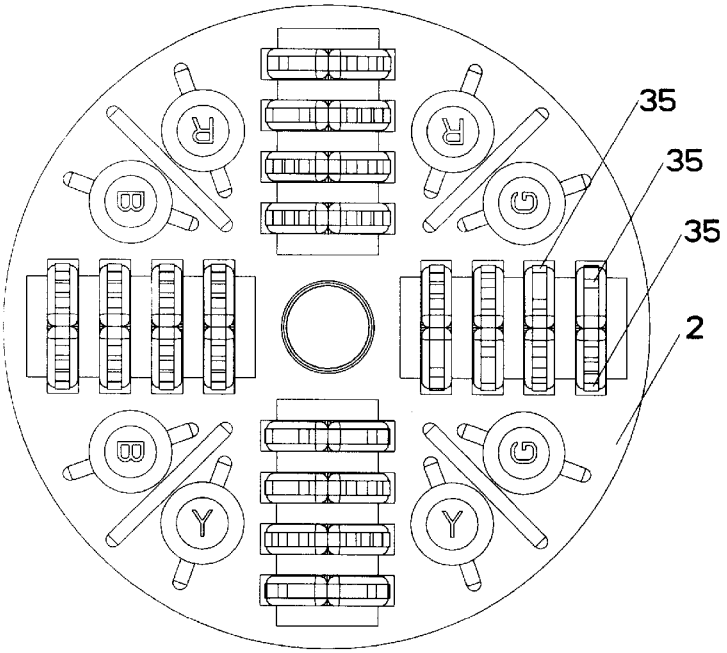
FIG. 8 is a similar view but as seen from below.
Figure 9:
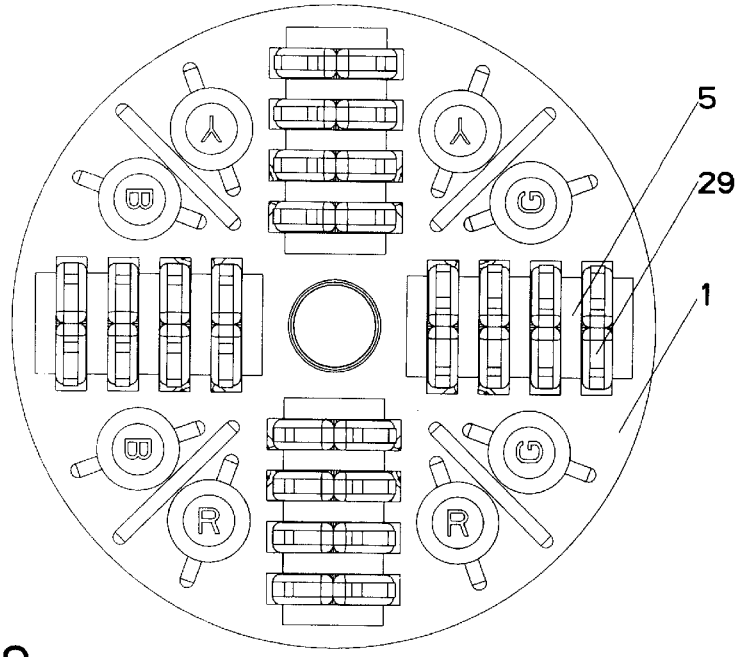
FIG. 9 is a view showing a logical toy from above with logical elements with marks grounded in accordance with sequence I, II, III, IIII, but the bottom plate is turned relative to the top plate.

The operation of the toy is performed in the following manner:

In the initial position the plates 1 and 2 are oriented so that the marks of color 27, reliefs 35, drawings 43 or numbers 44 provided on them coincide from both sides of the plates 1 and 2 as shown in FIGS. 3 and 5. In other words the plates 1 and 2 are located in order. Near the marks of the colors 27, (or relieves 35, drawings 43, numbers 44), groups of cylinders with toy logical elements 29 are located, which are also arranged in an order. In particular, the cylinder with the logical elements 29 of red color R is located between the marks 27 R, R of red color; the cylinder with the logical elements of green color G is located between the marks 27 G, G of green color; the cylinder with the logical elements 29 of yellow color Y is located between the marks 27 Y, Y of yellow color; the cylinder with the logical elements 29 of blue color B is located between the marks 27 B, B of blue color. In addition, within a group of cylinders with toy logical elements 29, the toy elements 29 which touch each other are also located in order by the relieves 35, drawing 43 and numbers 44. For example, the toy logical elements 29 can be located in an orderwith a sequence of reliefs I, II, III, IIII, as shown in FIGS. 1, 3, 5, 24, 28 in a sequence of drawings and symbols 43 as shown in FIGS. 23, 25, or numbers 44 as shown in FIGS. 26, 27.

The order of location of the toy logical elements 29 on the plates 1 and 2 in the initial position can be given both during assembly of the toy in a factory and also before the beginning of playing by a user. For this purpose, the toy can have both permanent immovable inserts 26 shown in FIGS. 1–11, and also removable turning inserts 49 and 50 shown in FIGS. 23 and 28.

Figure 20:
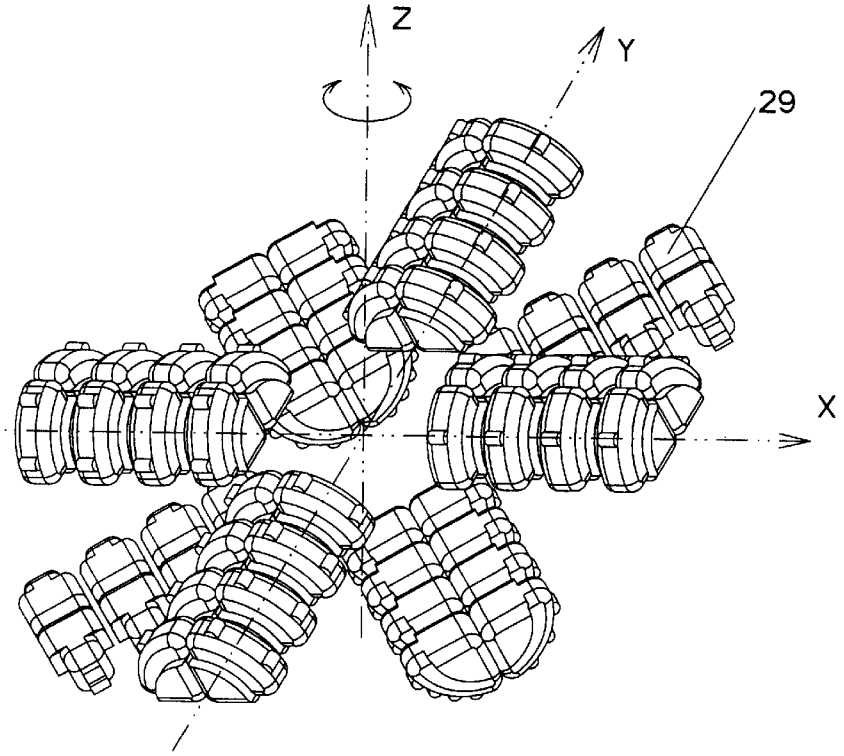
FIG. 20 is a view showing an offset location of the toy logical elements on a perspective view with the plates which are offset one another but not shown.
Figure 22:
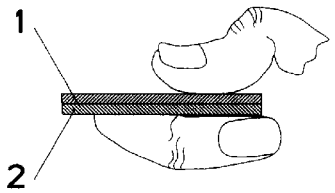
FIG. 22 is a view showing an example of turning or displacement of the plates by fingers.

During turning of the plate 1 relative to the plate 2 or visa versa as shown in FIGS. 10, 22, the spherical projections 18 of the plate 1 are disengaged from the depressions 13 of the plate 2 as shown in FIGS. 15 and 16. The plate 1 is lifted above the plate 2, but the ring-shaped projection 17 remains engaged with the ring-shaped passage 11, since the height of the ring-shaped projection 17 is greater than the height of the spherical projection 18. The provision of the permanent engagement makes possible a concentric turning of one plate 1 relative to the other plate 2. The spring 4 provides a constant spring-biasing of the plate 1 and 2 and toy logical element 29. Together with the plate 1, a half of the toy logical element 29 is displaced as well as shown in FIGS. 10, 20. They slip with their surfaces along the inner surface of the neighboring plate and along the surfaces located on the neighboring plate of the toy logical element 29. The relative turning of the plates 1 and 2 continues until engagement of the spherical projections of the plate 1 with the depressions 13 of the plate 2. The angle of turning of one plate relative to one another can be a multiple of 360°/K where K is a number of groups of cylinders with the toy logical elements 29 on the plates 1 and 2 and having a common axis of turning. For example, if the toy has four groups of cylinders with toy logical elements 29 as shown in FIGS. 1, 23, 25, then a minimal angle of the turning of the plates is equal to 360°/4 or 90°. If the toy has three groups of cylinders with toy logical elements 29 as shown in FIGS. 24, 28, the minimal angle of turning of the plates is equal to 360°/3 or 120°. If the toy has eight groups of cylinders with toy logical elements 29 as shown in FIG. 26, the minimal angle of turning of the plates is equal to 360°/8 or 45°.

Figure 19:
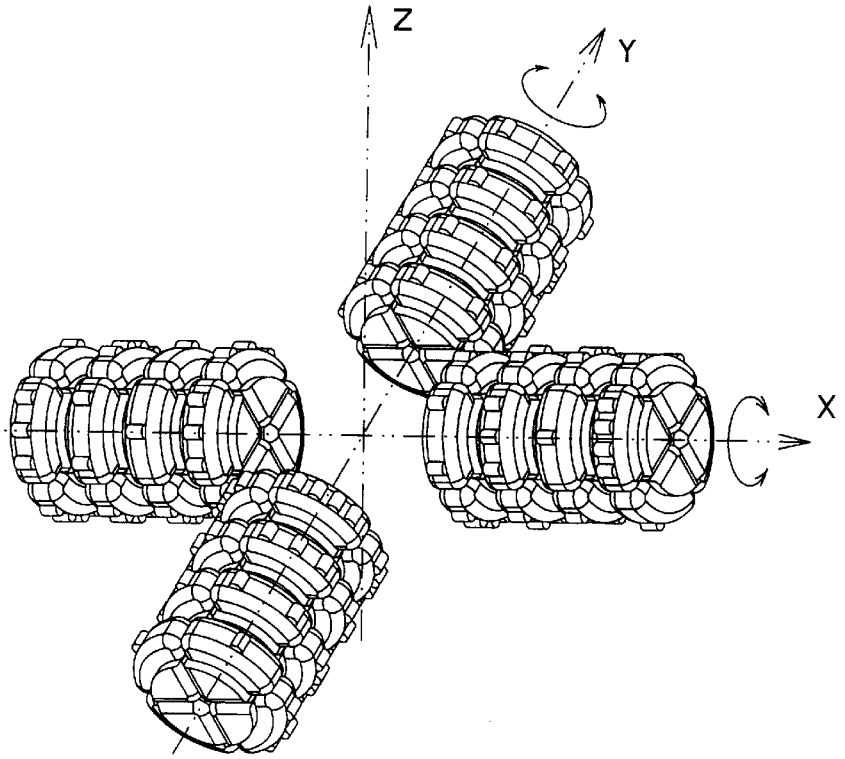
FIG. 19 shows an example coincided arrangement of the toy logical element on a perspective view with the plates coinciding with one another but not shown.
Figure 21:
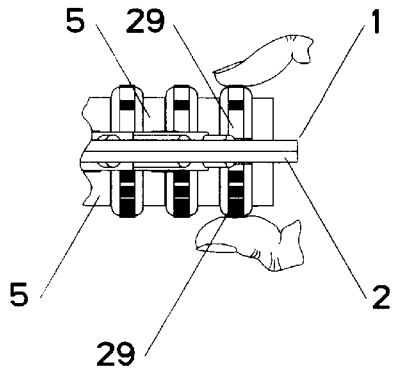
FIG. 21 is a view showing an inventive toy with an example of turning of toy logical elements by fingers.

A special case is a toy shown in FIG. 27, since on the plates 1 and 2 there are 16 groups as cylinders with toy logical elements 29, and the cylinders are located on the plates in pairs, radially and with offset therebetween by an angle L°. In this case the angle of turning of the plates 1 and 2 can be equal to 360°/K+L°, 360°/K, 360°/K−L°, L°, where K is a number of pairs of groups of the cylinders of the toy elements 29, L° is an angle between two groups of cylinders of toy logical elements 29 in a pair. The displacement of the plates 1 and 2 leads to the turning of a half of group of cylinders with toy logical elements 29 about a central axis of turning of the plates 1 and 2 or a conditional axis Z shown in FIGS. 10 and 20. In such an intermediate position, the toy logical elements 29 can not rotate since their surfaces are located on the surfaces of the plates 1 and 2. After the final turning or additional turning of the plates 1 and 2 by an angle which is a multiple of 360°/K the spherical projections 18 of the plate 1 again engage with the depressions 13 of the plate 2. The plates 1 and 2 are easily stopped therebetween by the projections 18 and depressions 13. Halves of cylinders of the groups of toy logical elements 29 coincide, and there is again a possibility of turning around conditional common axes of the cylinders X and Y as shown in FIGS. 19 and 21.

The new position of the plates 1 and 2 is characterized by the fact that the toy is already disoriented, since the marks of color 27, drawings 43, or numbers 44 from both sides of the plates 1 and 2 do not coincide. In addition, the integrity of the groups of cylinders of the toy logical element 29 is distorted, since within each group of the cylinders, the toy logical elements 29 of different colors will be located and not as the same color as in the initial position.

Figure 14:
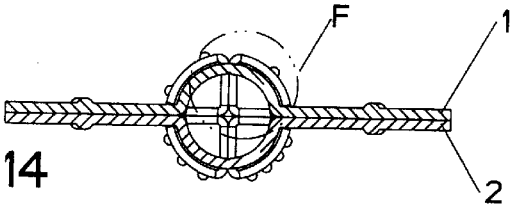
FIG. 14 is a view showing a section C—C in FIG. 5.

The next step is turning of the game logical elements 29 within each group by angle M° which is a multiple of the angle of opening of the toy logical element 29. In other words, if the toy is composed of toy logical elements 29 formed as one half of a cylinder, then the angle of turning of the toy logical elements M° will be a multiple of 360°/2 or 180°; if the toy is composed of toy logical elements 29 formed as one quarter of a cylinder, the angle of turning of the toy logical elements M° will be a multiple of 360°/4 or 90°; if the toy is composed of toy logical elements 29 formed as ⅙th of a cylinder, then the angle of turning of the toy logical element M° will be multiple of 360°/6 or 60° as shown in FIG. 39A–43, etc. During turning of the toy logical elements 29 above the conditional axis X and Y as shown in FIG. 19 located on the collars 30 of the toy logical elements 29, the fixators formed as projections 36 and depressions 37 and 38 are disengaged from the slots 14 and the projection 15 on the arcs 5 of the plates 1 and 2 as shown in FIGS. 16, 17. The plates 1 and 2 depart as shown in FIG. 16 and at the same time remain biased by the spring 4 shown in FIGS. 12, 13. In the moment of turning of the toy logical elements 29, the plates 1 and 2 can not turn since the inner contacting or mated surfaces of the plates 1 and 2 do not coincide with all surfaces of the toy logical elements 29 or in other words they are not aligned. After turning of the toy logical elements 29 by angle M°, the projections 36 or depressions 37 and 38 engage with the slots 14 and projections 15 on the arcs 5 on the plates 1 and 2 shown in FIG. 16, 17. The plates 1 and 2 are pressed under the action of the spring 14. The planes of the toy logical elements 29 are aligned with the inner mated surfaces of the plates 1 and 2. The position of the toy logical elements 29 is again fixed by the projections 36 and slots 14 or depressions 37 and 38 and the projections 15 as shown in FIGS. 14, 17, 18.

The new position of the toy is characterized by the fact that the plates 1 and 2, as well as the toy logical elements 29 have a possibility of turning; however, their mutual location in correspondence with the marks 27, relieves 35, drawings 43, numbers 44 is distorted.

The objective of a user is by a successive alternative turning of the plates 1 and 2 and toy logical elements 29, to restore the initial mutual position of all parts of the toy, or in other words of the plates 1 and 2, the toy logical elements 29, the marks 27, the relieves 35, the drawings 43, the numbers 44. Or the objective is to create a new predetermined color pattern, a new sum of numbers, a new word, a new relief, etc.

The massaging inserts 40, and the attachments 51 and 52 impart to the toy new therapeutic properties, since they provide massaging of user's fingers during the process of turning of the parts of the toy.

The removable turnable inserts 49 and 50 with the attachment 57 operate in the following manner. In the initial position the toy is assembled as shown in FIG. 23. The drawings 43 on the toy logical elements 29 and their colors correspond to the drawings 43 and the colors 27 Y, R, G, B of the insert 50 and the attachment 57. The user turns the insert 50 by the ribs 53 by the angle which is a multiple of 360°/K, wherein K is a number of groups of cylinders of the toy logical elements 29, in this case K equals 4. During turning of the insert 50, the groove 55 is displaced, the spherical formation 61 which spring biases the insert 50 is lifted due to the slots 62 as shown in FIG. 46A, 46B. The position of the insert 50 is no longer fixed. When the spherical formation 61 engages in a next groove 55, the position of the insert 50 is again fixed as shown in FIG. 48. As a result of turning of the insert 50, the mutual position of the plates 1 and 2 is distorted since the marks of color 27 forthe plates 1 and 2 no longer coincide from both sides. In addition, the colors on the toy logical elements 29 do not correspond to the colors 27 of the insert 50. A user must successively turn the plates 1 and 2 and the toy logical elements 29 so as to restore the initial position, without changing the position of the insert 50.

The operation of the insert 49 and 50 in FIGS. 25, 26, 27 is analogously to the one described above. The marks of colors 27, the drawings 43, the numbers 44 around the inserts 49 and 50 determine the position of the toy logical elements 29 with the same marks of color 27, drawings 43, numbers 44 on the plates 1 and 2 from both sides. The turning of at least one of the inserts 49 or 50 by an angle to its next fixation converts the toy into a disoriented position since on the toy logical elements 29 of the marks of color 27, drawings 43 or the numbers 44 do not correspond to the position of the same marks, drawings or numbers on the inserts.

The insert 49 and 50, as well as the massaging attachments 51 and 52, can be easily pressed out from the plates 1 and 2 of the toy when it is not needed or complicated. For this purpose on the attachments 51, 52 and 57 there are undercuts 63.

The removable turnable inserts 49 and 50 with the attachments 57 increase the attractiveness of the toy, since a user can change the complexity of the problems to be resolved, makes possible to provide in advance patterns of location of the elements of the toy and also when needed to convert the toy to the initial position fast even without the required turning of the plates 1 and 2 and the toy logical element 29 due to the removal and turning of the turnable inserts.

The toy can be used by adults as well as by kids from five years of age. It can be used also by blind people. It can be used for restoring of motion functions of fingers, for performing competitions, tests or testing of mental abilities and color perception.

Playing with the toy develops a logical and analytically thinking, spacial and color imagination, orientation, proper targeting, etc.

The toy can be supplied as a set of elements with the rules for assembly disassembly, mounting of additional plates and attachments.

It will be understood that each of the elements described above, or two or more together, may also find a useful application in other types of constructions differing from the types described above.

While the invention has been illustrated and described as embodied in logical toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

One experimental working sample was made by inventor and could be shown upon request any time for better understanding all described above and how the toy works.

What is claimed as new and desired to be protected by letters patent is set forth in the appended claims:

1. A logical toy, comprising two coaxial, spring-biased parallel plates formed as disks which are concentrically turnable about a common axis and are provided with arcs; a plurality of toy logical elements surrounded by said arcs and turnable inside said arcs, said toy logical elements being formed as parts of a cylinder, one of said plates having an inner surface provided with a ring-shaped passage with depressions for fixing of a mutual turning position of said plates, the other of said plates having an inner surface provided with ring-shaped projection corresponding to a diameter of said ring-shaped passage and having spherical projections, said ring-shaped projections having a height which is greater than a height of spherical projections, said ring-shaped passage with said depressions and said ring-shaped projection with said spherical projections being located concentrically to said axis of turning of said plates at a minimal distance from said axis, said arcs and said inner surfaces of said plates having a common sides provided with radii, said inner surfaces of said arcs having fixators of position of said toy logical elements which are formed as transverse slots, said plates being provided with setting openings; a movable and immovable attachments pressed-in said setting openings; massaging attachments and further attachments pressed in an outer surface of said plates being defined by an axle; inserts in said further attachments, said axis of rotation of said plates having one end provided with a head and another end provided with a collar formed with inclination from a smaller diameter at a base of said axis to a greater diameter closer to a center of said axis, said axis of turning being provided with at least one longitudinal slot.

2. A logical toy as defined in claim 1, wherein said plates are formed as polygons.

3. A logical toy as defined in claim 1, wherein said other plate has a further ring-shaped passage and depressions with setting openings in said depressions and with an insert provided with setting projections insertable in said setting openings, said insert being arranged in said ring-shaped passage of said other plate so as to form said ring-shaped projection.

4. A logical toy as defined in claim 3, wherein said insert has a shape corresponding to said ring-shaped passage and said ring-shaped projection and has spherical projections for fixing of a relative turning position of said plates.

5. A logical toy as defined in claim 1, wherein said axle is composed of an elastic material.

6. A logical toy as defined in claim 1, wherein said arcs are provided with slots for increasing springy properties and fixation of said toy logical elements on said arcs.

7. A logical toy as defined in claim 1, wherein said plates have outer surfaces provided with massaging projections.

8. A logical toy as defined in claim 1, wherein at least some of said attachments have setting projections and undercuts for pressing into said plates and pressing-out.

9. A logical toy as defined in claim 1, wherein said massaging attachments are arranged at locations which are convenient for finger massage and provide therapeutic effect during playing.

10. A logical toy as defined in claim 1; and further comprising groups of cylinders provided with toy logical elements and having axes of turning located in a plane of said plates at an angle equal to 360°/K wherein K is a number of the groups of cylinders with said toy logical elements.

11. A logical toy as defined in claim 1, wherein some of said attachments are formed as disks with cylindrical lowerings and spherical formations at an inner part of said lowering, each of said formations from both sides being provided with throughgoing slots for increasing elastic properties of said attachments; and further comprising turning inserts located inside said attachments in said cylindrical lowering and formed as disks with ribs for turning of said inserts by a predetermined angle, said turning inserts having a face surface provided with grooves which cooperate with said spherical formations of said insert and formed for fixation of turning of said insert.

12. A logical toy as defined in claim 11, wherein said turning inserts are composed of elastic material.

13. A logical toy as defined in claim 11, wherein said turning inserts have central openings for mounting said turning inserts coaxially with turning of said plates.

14. A logical toy as defined in claim 11, wherein said turning inserts have a front surface provided with a group of symbols in a number and nature corresponding to groups of symbols provided on said toy logical elements, said symbols being located on said turning inserts between said ribs.

15. A logical toy as defined in claim 11, wherein said spherical formations of said inserts having sizes corresponding to sizes of said grooves of said turning inserts, said grooves being located radially and being provided in a number corresponding to a number of symbols provided on said turning inserts.

16. A logical toy as defined in claim 1, wherein each of said logical elements is formed as a part of a cylinder and has sides rounded at all corners in planes located in contact with one another during displacement of said plates, said toy logical element also having fixators of position provided on a cylindrical surface of said collars and formed as a formation selected from the group consisting from a projection, a depression and a flat area.

17. A logical toy as defined in claim 16, wherein said toy logical element has a front slot having a shape selected from the group consisting of a dove-tail and a rectangle, and is open at an apex of said logical element, said frame slot having a base provided with at least one opening.

18. A logical toy as defined in claim 17, wherein said toy logical element has an insert with a shape corresponding to said front slot and is provided at a front surface with a symbol selected from the group consisting of a relief, a mark and a drawing, said insert having a base provided with at least one certain projection for fixing in said front slot.

19. A logical toy as defined in claim 16, wherein said projections, depressions and flat areas provided on said cylindrical surface of said collar correspond to sizes of slots or projections provided on inner surfaces of said arcs.

20. A logical toy as defined in claim 1, wherein each of said logical elements is formed as a part of a cylinder and has sides chamfers at all corners in planes located in contact with one another during displacement of said plates, said toy logical element also having fixators of position provided on a cylindrical surface of said collars and formed as a formation selected from the group consisting from a projection, a depression and a flat area.

* * * * *